United States Patent [19]

Coolidge et al.

[11] Patent Number: 5,007,493

[45] Date of Patent: Apr. 16, 1991

[54] DRILL BIT HAVING IMPROVED CUTTING ELEMENT RETENTION SYSTEM

[75] Inventors: Robert B. Coolidge, Spring; David M. Nguyen, Houston, both of Tex.

[73] Assignee: Dresser Industries, Inc., Dallas, Tex.

[21] Appl. No.: 484,406

[22] Filed: Feb. 23, 1990

[51] Int. Cl.[5] ..... E21B 10/46

[52] U.S. Cl. ..... 175/329; 76/108.2; 175/409

[58] Field of Search ..... 175/327, 329, 410, 411, 175/421; 299/91; 76/108.2, 108.4

[56] References Cited

U.S. PATENT DOCUMENTS

| | | | |
|---|---|---|---|
| 4,607,711 | 8/1986 | Zijsling | 175/329 |
| 4,632,196 | 12/1986 | Dennis | 175/329 |
| 4,640,375 | 2/1987 | Barr et al. | 175/410 |
| 4,669,556 | 6/1987 | Barr et al. | 175/329 |
| 4,674,802 | 6/1987 | McKenna et al. | 175/410 X |
| 4,682,663 | 7/1987 | Daly et al. | 175/329 |
| 4,724,913 | 2/1988 | Morris | 175/329 |
| 4,749,052 | 6/1988 | Dennis | 175/329 |
| 4,830,123 | 5/1989 | Daly et al. | 175/329 |

FOREIGN PATENT DOCUMENTS

| | | | |
|---|---|---|---|
| 326176 | 8/1989 | European Pat. Off. | 175/329 |

*Primary Examiner*—Ramon S. Britts
*Assistant Examiner*—David J. Bagnell
*Attorney, Agent, or Firm*—Johnson & Gibbs

[57] ABSTRACT

A cutting element retention system is shown for a diamond drill bit. The drill bit has a bit body with a bit face, the bit face having polycrystalline diamond cutting elements received thereon within mating recesses provided in the face. Each cutting element has a mounting body with a leading face and a trailing face and a diamond layer carried on the leading face. At least one fin with associated troughs are located behind the mounting body on the bit face or within the carrier substrate or cutting element itself and arranged transverse to the cutting element layer. The fins are separated by a trough which extends for substantially the entire cross-sectional depth of the diamond cutting face.

12 Claims, 2 Drawing Sheets

DRILL BIT HAVING IMPROVED CUTTING ELEMENT RETENTION SYSTEM

BACKGROUND OF THE INVENTION

1. Field of the Invention

The present invention relates to cutting tools of the type utilizing fixed cutter cutting elements and, specifically, to an improved cutting element retention system for mounting a fixed cutter cutting element on the face of an earth boring drill bit.

2. Description of the Prior Art

"Fixed cutter" is the industry standard terminology used to describe a type of bit which does not use a cutting structure with moving parts, such as a rolling cone bit. Fixed cutter terminology has been officially adopted by the International Association of Drilling Contractors (IADC) Drill Bit Subcommittee. Fixed cutter categorization includes Polycrystalline Diamond Compact (PDC), Thermally Stable Polycrystalline (TSP), Natural Diamond, and Other. "Other" is a category of fixed cutter bit that does not use a diamond material of any kind as its cutting element. Commonly tungsten carbide is used as the substitute. It is understood that throughout the following discussion, where reference is made to "diamond" cutting elements, PDC, TSP, Natural diamond and "Other" cutting elements such as tungsten carbide are also intended to be included.

A variety of cutting tools are known which are well suited for receiving diamond cutting elements as the cutting or wear portion of the tool. Known applications include, for instance, the mining, construction, and oil and gas exploration and production industries. An important category of such tools is the earth boring drill bit of the type used to drill oil and gas wells. The commercially available earth boring bits are generally classified as either rolling cutter bits, having steel teeth or tungsten carbide inserts, and diamond bits which utilize either natural diamonds or artificial or man-made diamonds.

The diamond earth boring bits are further classified as either steel bodied bits or matrix bits. The steel bodied bits are machined from a steel block and typically have cutting elements which are press-fit into openings provided in the bit face. The matrix bit is formed by coating a hollow tubular steel mandrel in a casting mold with metal bonded hard material, such as tungsten carbide. The cast mold is of a configuration which will give a bit of the desired form. The cutting elements are typically either polycrystalline diamond compact cutters braised within an opening provided in the matrix backing or are thermally stable polycrystalline diamond cutters which are cast within recesses provided in the matrix backing.

The prior art cutting element retention systems were therefore basically of two styles: (1) a tungsten carbide stud press-fit into a recess on the bit face; and (2) mechanical and/or braised attachment of the cutting element into a cast recess (hole) provided in a tungsten carbide matrix bit face or attachment of the cutting element into a pocket (boss) provided on the cast matrix bit face. In either system, the forward portion of each system was designed to provide sufficient cutting element attachment and retention. The rearward portion of the system behind the cutting element was required to provide mechanical strength sufficient to withstand the forces exerted during the drilling operation. An essential requirement was that the rearward portion of the retention system not unduly flex, break or erode.

The stud carrier typically utilized in the above applications came in various styles including "flat top" and "round top" styles. Whatever style, the stud carrier typically featured a solid, blocky mass behind the cutting element without the presence of any void areas. Likewise, in the mechanical and/or braised attachment system, a solid, blocky mass of cast tungsten carbide was utilized behind the cutting element to provide sufficient mechanical strength. This mass typically did not feature void space and was approximately the shape of a sphere quarter-section, positioned with one flat side against the back of the cutting element and another flat side toward the bit face, causing the rounded edge to become the exposed top of the rear of the pocket mass.

In either system, three non-optimum conditions were required to be tolerated. First, as the cutting element wore, the bearing area of the bit face on the bottom of the borehole being drilled substantially increased. This caused an increasing amount of heat to be created which then was conducted through the cutter retention system. Excessive heat is detrimental to the heat sensitive cutting elements.

Secondly, the progressively increasing wear flat area created as the cutting element wears decreased product performance to the point of causing termination of the bit run due to excessive torque, excessive bit weight requirements, poor penetration rate and/or poor cutter retention rate.

Thirdly, because of the wear characteristics and associated limitations of the prior art cutter retention systems, currently used bits are frequently returned from the field with greater than 50% of the original diamond material remaining on the bit face The present invention has as its object to provide a drill bit with an improved cutting element retention system whereby a more complete cutting element usage is obtained.

Another object of the invention is to provide a cutting element retention system which provides sufficient strength for the cutting element while presenting an essentially minimum surface area to drag on the bottom of the borehole being drilled as the cutting element wears. Considerable forethought has been given to maintaining structural strength integrity in the retention system while maximizing the percent of diamond cutting element depth usable.

Another object of the invention is to reduce the cutting element temperature by generating less heat during use, then by quickly removing any unwanted heat which still is generated via convection heat transfer from the cutting element retention system.

SUMMARY OF THE INVENTION

THe drill bit of the invention includes a bit body having a connecting end for engaging the mating connecting end of a pipe string used to support the bit within the well bore and having an opposite end which defines a bit face. A plurality of fixed cutter cutting elements are received within mating recesses provided in the bit face, each fixed cutter cutting element having a mounting body with a leading face and a trailing face and a layer of superhard material carried on the leading face of the mounting body to define a cutting face for the cutting element. The cutting face has a cross-sectional depth. At least one fin and two troughs are located behind the mounting body on the bit face and lie in planes arranged to intersect the cutting face. Preferably, the fin and troughs are arranged generally transverse to the cutting face. Where more than one fin is utilized, the fins are separated by troughs which extend for substantially and in the preferred embodiment the entire, cross-sectional depth of the cutting face.

The bit face can be covered with a cast matrix material and the mating recesses can be located within the cast matrix body of the bit head, such as on a design commonly referred to as a "fishtail" bit. The fins and troughs can then be provided in the cast matrix material surrounding the recesses used to retain the cutting elements on the bit face. Alternatively, the fixed cutter cutting elements can be attached to a mounting stud which, in turn, is received within the mating recess provided on the bit face, the fins and troughs being provided as a part of the mounting stud by creating at least one fin and associated troughs in.

Additional objects, features and advantages will be apparent in the written description which follows.

BRIEF DESCRIPTION OF THE DRAWINGS

in FIG. 2;

in FIG. 5;

DETAILED DESCRIPTION OF THE INVENTION

Figure 1:
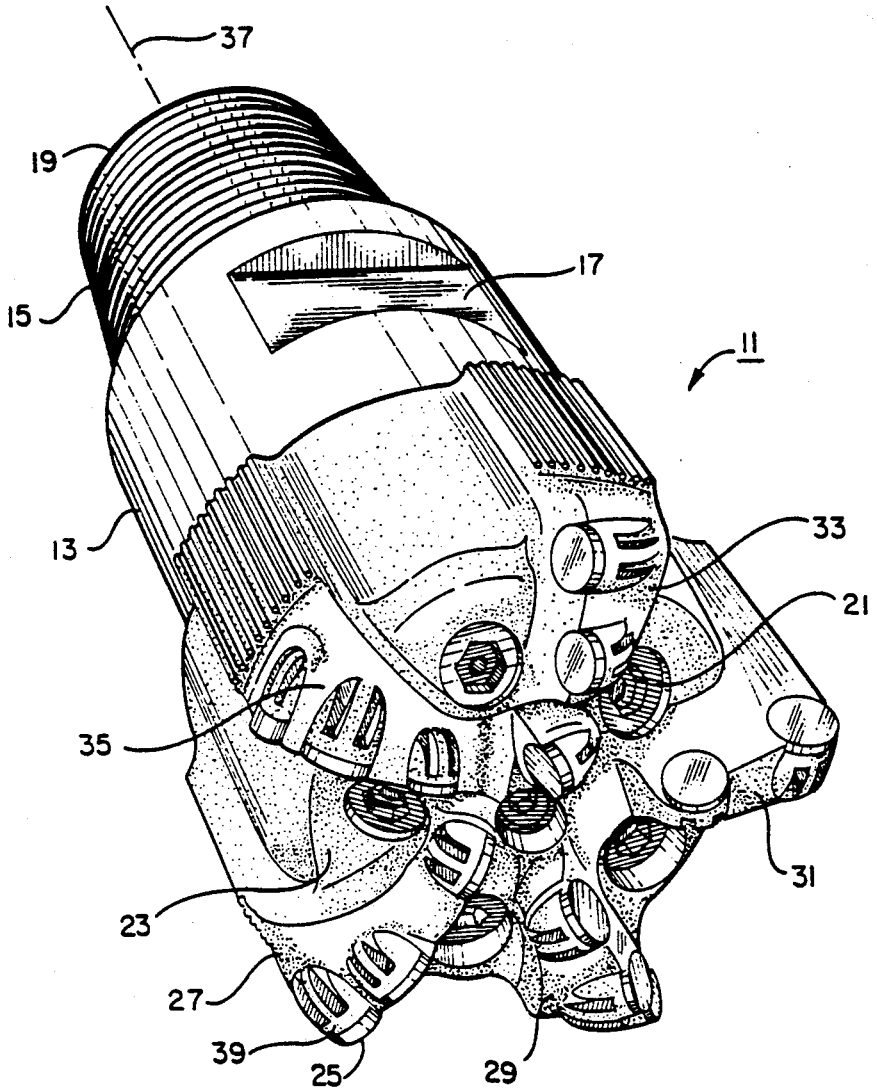
FIG. 1 is a perspective view of a bit of the invention showing the fixed cutter cutting elements on the bit face.

FIG. 1 shows a drill bit 11 featuring the improved fixed cutter cutting elements and cutting element retention system of the invention. The earth boring drill bit 11 has a body 13 with a threaded shank 15 formed on one end for connection with a drill string member (not shown). The body 13 can include a pair of wrench flats, commonly referred to as "breaker slots", 17 used to apply the appropriate torque to properly "make-up" the threaded shank 15. The body 13 also has a tubular bore 19 which communicates with the interior of the drill string member, and which communicates by internal fluid passageways (not shown) with one or more fluid openings 21 which are used to circulate fluids to the bit face.

On the opposite end of the bit body 13 from the threaded shank 15, there is formed a bit face comprised of steel or cast "matrix" 23 in a predetermined configuration to include polycrystalline diamond cutting elements 25. The matrix 23 is of a composition of the same type used in conventional diamond matrix bits, one example being that which is disclosed in U.S. Pat. No. 3,175,629, to David S. Rowley, issued Mar. 30, 1965. Such matrices can be, for example, formed of a copper-nickel alloy containing powdered tungsten carbide.

Matrix head bits of the type shown in FIG. 1 are manufactured by casting the matrix material in a mold about a steel mandrel. The mold is first fabricated from graphite stock by turning on a lathe and machining a negative of the desired bit profile. Cutter pockets are then milled into the interior of the mold to proper contours and dressed to define the position and angle of the cutting elements. The internal fluid passageways are formed by positioning a temporary displacement material within the interior of the mold which will later be removed.

A steel mandrel is then inserted into the interior of the mold and the tungsten carbide powders, binders and flux are added to the mold. The steel mandrel acts as a ductile core to which the matrix material adheres during the casting a cooling state. After firing the bit in a furnace, the mold is removed and the cutters are mounted on the exterior bit face within recesses in or protruding cutter receiving pockets of the matrix.

The bit body shown in FIG. 1 has a plurality of integral blades 27, 29, 31, 33, 35 which are formed of the cast matrix material and which extend axially in planes parallel to the longitudinal axis 37 of the bit and radially outward to terminate in relatively flat portions. As shown in FIG. 1, the blades 27, 29, 31, 33, 35, 37 have polycrystalline diamond cutting elements 25 mounted within the matrix for drilling the earthen formations. The backings 39 for the cutting elements 25 are portions of the matrix which protrude outwardly from the face of the bit and which are formed with cutter receiving pockets or recesses during the casting operation.

The cutting elements 25 are known in the art and are available from several commercial sources. They are formed by sintering a polycrystalline diamond layer to a tungsten carbide substrate and are commercially available to the drilling industry from, for instance, General Electric Company under the "STRATAPAX" trademark. The commercially available cutting elements have typically been cylindrical in shape having planar cutting faces, although other cutting elements have been proposed having non-planar cutting faces, for instance convex or concave. The cutting elements have typically been mounted in the recesses provided in the matrix and into the protruding cutter receiving pockets by braising the compacts within these areas.

Figure 2:
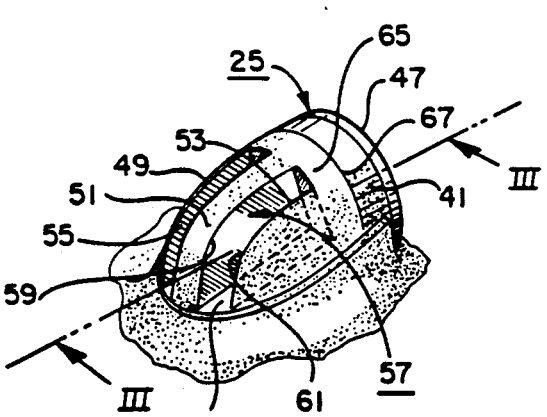
FIG. 2 is an isolated, perspective view of a single fixed cutter cutting element found on the face of the bit of FIG. 1.
Figure 3:
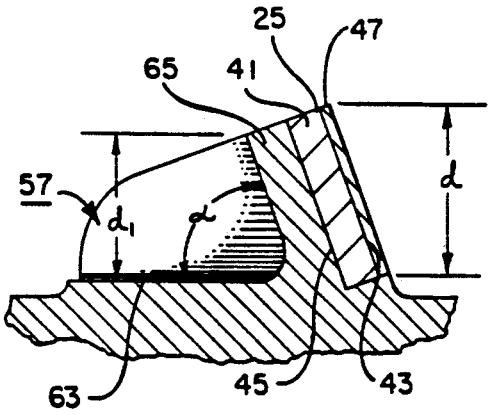
FIG. 3 is a side, cross-sectional view taken along lines III—III.

FIGS. 2 and 3 are isolated views of a cutting element 25 with its associated cutting element retention system shown in isolated fashion. The cutting element 25 includes a mounting body 41 of tungsten carbide having a leading face 43 and a trailing face 45 (see FIG. 3). A relatively thin layer 47 of superhard material is carried on the leading face 43 of the mounting body 41 and, in this case, defines a planar cutting face for the cutting element 25. It will be understood that other, non-planar cutting face geometries are possible. Preferably, the superhard material comprises polycrystalline diamond material. The mounting body 41 is preferably cemented tungsten carbide. As shown in FIG. 3, the planar cutting face 47 has a cross-sectional depth "d."

At least one fin is located behind the cutting face 47. In this case, the fin or fins are located behind the mounting body 41 o the bit face and arranged generally transverse to the planar cutting face 47. Preferably, three fins 49, 51, 53 are provided in the matrix backing on the bit face, the fins being separated by troughs 55, 57. Preferably, each trough 57 extends for substantially the entire cross-sectional depth of the planar cutting face 47, illustrated by "$d_1$" in FIG. 3.

Although the fins 49, 51, 53 are shown as being arranged generally transverse to the planar cutting face 47, it will be understood that in some applications the fins may be oriented at oblique angles with respect to the cutting face 47. For instance, as cutters become closer to the center of the bit, they typically receive drilling loads at an exacerbated angle. It can thus be desirable to create fins transverse to the drilling load rather than transverse to the plane of the cutter face. This angle can be 45° in the center of the bit.

In the bit of FIGS. 1–3 each fin 51 includes an interior sidewall 59 which defines one sidewall of an associated trough 57, the trough sidewall so defined being separated from the next adjacent sidewall 61 by a trough bottom 63. Preferably, the trough sidewalls 59, 61 are generally parallel. However, a small change in width of the fin as a function of depth of cutter wear can be tolerated. Each trough 57, located behind mounting body 41, can be separated from the trailing face 45 of the mounting body by a support region 65 which extends generally transverse to the direction of the trough 57. The support region includes a leading planar face 67 which fits flush against and is bonded to the trailing face 45 of the cutting element mounting body 41. The point of intersection of each trough 57 with the support region 65 is a rounded corner which, in the preferred embodiment shown in FIG. 3, forms an acute angle alpha with the trough bottom 63.

Figure 4:
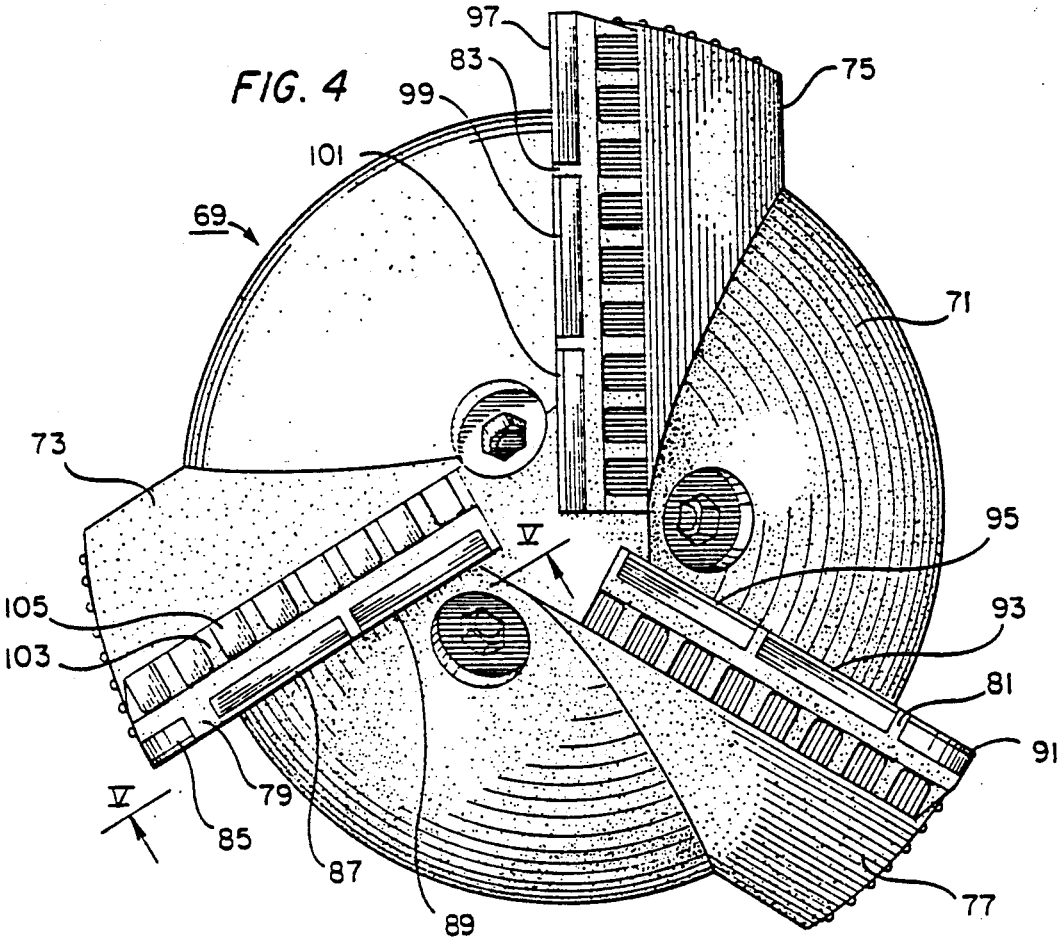
FIG. 4 is a top, perspective view of another bit employing the cutting elements and cutting element retention system of the invention as might be embodied on what is commonly referred to as a "fishtail" bit.
Figure 5:
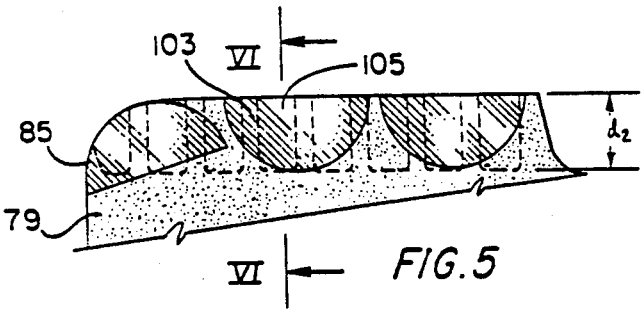
FIG. 5 is a front view of the blade of the bit of FIG. 4 taken along lines V.—V. showing the placement of the cutting elements with the associated troughs shown in dotted lines.

FIG. 4 shows another diamond bit 69 which, like the bit 11, has an end covered with cast matrix material which defines a bit face 71. A plurality of integral blades 73, 75, 77 are formed of the cast matrix material and extend axially and radially from the bit face 71 and terminate in relatively flat portions 79, 81, 83 having cutting edges. A plurality of polycrystalline diamond cutting elements 85, 87, 89, 91, 93, 95, 97, 99, 101 are located on the flat portions of the blades, similar to the cutting elements 25, and are arranged in planes generally parallel to the longitudinal axis of the bit. In the embodiment of FIG. 4, a plurality of fins 103 and alternating fins and troughs 105 are located in the matrix material of the blade behind the cutting elements. As shown in FIG. 5, each cutting element has a cross-sectional depth and the troughs 105 in the preferred embodiment of FIGS. 4–6, extend vertically through the matrix material 79 substantially the entire cross-sectional depth of the cutting face, illustrated as "$d_2$" in FIG. 5. It will be understood that, in other embodiments, the troughs 105 may extend for less than the full depth "$d_2$."

Figure 6:
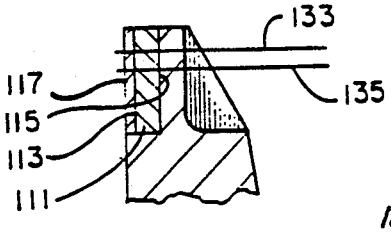
FIG. 6 is a side, cross-sectional view taken along lines VI.—VI.
Figure 7:
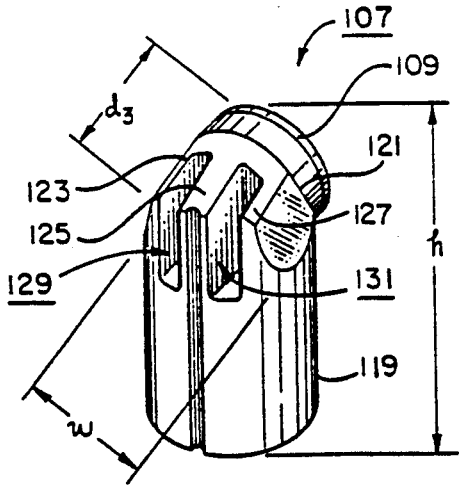
FIG. 7 is an isolated, perspective view of a stud mounted element of the invention.

FIGS. 6 and 7 show a stud mounted cutting element assembly for a drill bit designated generally as 107. The assembly 107 includes a polycrystalline diamond cutting element 109 having a mounting body 111 (FIG. 6) with a leading face 113, a trailing face 115 and a polycrystalline diamond layer 117 carried on the leading face 113 to define a planar cutting face for the cutting element. A mounting stud 119 is provided for mounting in a mating recess provided on a drill bit, such as the vertical opening provided in a steel bodied bit. The trailing face of the mounting body 111 is bonded to a planar surface 121 of the mounting stud 119. Three fins 123, 125, 127 are located behind the mounting body 111 in the surface of the mounting stud 119. The fins are arranged generally transverse to the planar cutting face 117 but may be angularly adjusted so as to be transverse to the actual direction of cutter loading due to the oncoming formation. Each fin is separated from the next adjacent fin by a trough 129, 131 which extends for substantially the entire cross-sectional depth of the cutting face (See FIG. 6).

Figure 8:
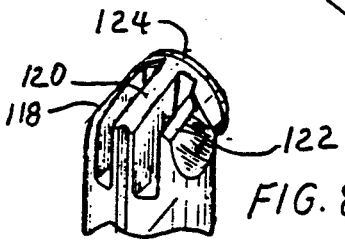
FIG. 8 an isolated, perspective view of fins and troughs created in an actual carrier material such as the tungsten carbide substrate used with polycrystalline diamond compact cutting elements.

FIG. 8 shows another embodiment of a cutting element retention system in which the fins 118, 120, 122 are created in the actual carrier material such as the tungsten carbide substrate used with the polycrystalline diamond compact 124. The use of fins and troughs in the substrate can thus be seen to be adaptable to both stud mounted cutting elements and "pocket" mount cutting element retention systems.

Returning to the embodiment of FIGS. 6 and 7, each cutting element 109 with its bonded mounting stud 119 defines a cutting element body having a height "h", a width "w", and a depth "$d_3$". During normal drilling, the cutting element body produces a wear flat which comprises a transverse section drawn through the body. FIG. 6 illustrates a first transverse section 133 and a second transverse section 135. As drilling progresses, the bearing area which contacts the bottom of the borehole normally increases due to the increased surface area of the transverse section bearing on the borehole. By providing a series of alternating fins and troughs, the present cutting element retention system retards and effectively minimizes the normal increase in bearing area created due to the surface of the cutting element backing rubbing on the bottom of the borehole as the cutting element wears.

An invention has been provided with significant advantages. The finned cutting element retention system of the invention provides sufficient strength with less surface area to drag on the bottom of the borehole as the cutting element wears. As a result, less heat is generated to be conducted to or damage the diamond elements. Progressively increasing wear flats can be entirely eliminated in the preferred embodiment and can be essentially eliminated where design constraints are allowed precedence over the objective of exact elimination of increasing wear flats. The result is increased product performance, lowering of torque requirements and bit weight, and increased penetration rate of the bit. The fin design provides convective heat transfer away from the heat sensitive diamond material, thereby prolonging the life of the cutting elements. By properly designing the geometry and total mass of the fins, the surface area of the cutting element retention system can approach being a constant cross-sectional area throughout the entire cutting element usage. More complete cutting element usage is attained, thereby substantially increasing the value of the product. Structural mechanics show that fins transverse to loads require the least mass for equivalent load-bearing capacity. Therefore, by angle cutting or scooping out the rear of the cutter retention system, strength and heat transferability are maximized.

While the invention has been shown in only two of its forms, it is not thus limited but is susceptible to various changes and modifications without departing from the spirit thereof.

We claim:

1. A drill bit having an improved cutting element retention system for drilling a well borehole having a bottom, the bit comprising:

a bit body having a connecting end for engaging the mating connecting end of a pipe string used to support the bit within the well bore, the bit body having an opposite end which defines a bit face;

a plurality of fixed cutter cutting elements received on the bit face, each fixed cutter cutting element having a mounting body with a leading face and a layer of superhard material carried on the leading face of the mounting body to define a cutting face for the cutting element;

at least one fin and two troughs located behind the cutting face of the cutting element and being a part of the mounting body on the bit face, said troughs being defined by substantially parallel sidewalls; and whereby each cutting element has a characteristic wear flat bearing area created by contact between the cutting element and the borehole bottom, the said fin and troughs located behind the cutting face of the cutting elements serving to minimize any increase in wear flat bearing area as the cutting elements wear.

2. A drill bit having an improved cutting element retention system for drilling a well borehole having a bottom, the bit comprising:

a bit body having a connecting end for engaging the mating connecting end of a pipe string used to support the bit within the well bore, the bit body having an opposite end which defines a bit face;

a plurality of fixed cutter cutting elements received on the bit face, each fixed cutter cutting element having a mounting body with a leading face and a layer a superhard material carried on the leading face of the mounting body to define a cutting face for the cutting element, the cutting face having a cross-sectional depth; and at least one fin and two troughs located behind the cutting face of the cutting element and being a part of the mounting body on the bit face, the fin and troughs being arranged generally transverse to the cutting face, the fin being located between the two troughs with the troughs extending for substantially the entire cross-sectional depth of the cutting face.

3. The drill bit of claim 2, wherein the fixed cutter cutting elements include polycrystalline diamond cutting elements and wherein the polycrystalline diamond cutting elements are each attached to a mounting stud which, in turn, is received within a mating recess provided in the bit face, and wherein the fin and trough are provided as a part of the mounting stud.

4. The drill bit of claim 2, wherein the bit face is covered with a cast matrix material having mating recesses located within the cast matrix, and wherein the fin and troughs are provided in the cast matrix material surrounding the recesses used to retain the cutting elements on the bit face.

5. The drill bit of claim 2, wherein each trough located behind the mounting body is separated from the trailing face of the mounting body by a support region which extends generally transverse to the direction of the trough.

6. The drill bit of claim 5, wherein each fin includes an interior sidewall which defines one sidewall of an associated trough, the trough sidewall so defined being separated from the next adjacent sidewall by a trough bottom, and wherein the trough sidewalls are generally parallel and intersect the support regions at an intersecting region.

7. The drill bit of claim 6, wherein the intersecting region of each trough with the support region of the cutting element is a rounded corner which forms an acute angle with the trough bottom.

8. A matrix drill bit having an improved cutting element retention system for drilling a well borehole having a bottom, the bit comprising:

a metallic mandrel having an interior bore, a connecting end for engaging the mating connecting end of a pipe string used to support the bit within the well bore, and an opposite end covered with a cast matrix material which defines a bit face, the cast matrix material having a wear resistance substantially greater than that of the metallic mandrel;

a plurality of polycrystalline diamond cutting elements received within mating recesses provided in the matrix material of the bit face, each polycrystalline diamond cutting element having a mounting body with a leading face and a trailing face and a relatively thin layer of superhard material carried on the leading face of the mounting body to define a planar cutting face for the cutting element, the planar cutting face having a cross-sectional depth;

at least two fins located behind the mounting body in generally transverse to the planar cutting face, the fins being separated by a .trough which extends vertically through the matrix material for substantially the entire cross-sectional depth of the cutting face; and wherein each cutting element has a characteristic wear flat bearing area created by contact between the cutting element and the borehole bottom, the said fins and trough located behind the mounting body serving to reduce the wear flat bearing area as the cutting elements wear.

9. The matrix drill bit of claim 8, further comprising:

a plurality of integral blades formed of the cast matrix material and extending axially and radially from the bit face and terminating in relatively flat portions having cutting edges, the polycrystalline diamond cutting elements being located thereon, and wherein the fins and trough are located in the matrix material of the blades behind the cutting elements.

10. A cutting element assembly for a drill bit, comprising:

a polycrystalline diamond cutting element having a mounting body with a leading face and a trailing face and a relatively thin layer of superhard material carried on the leading face of the mounting body to define a planar cutting face for the cutting element, the planar cutting face having a cross-sectional depth;

a mounting stud for mounting in a mating recess provided on a drill bit, the trailing face of the cutting element mounting body being bonded to a surface of the mounting stud; and wherein at least one fin and a plurality of troughs are located behind the mounting body in the surface of the mounting stud, the fin being arranged generally transverse to the planar cutting face, for substantially the entire cross-sectional depth of the cutting face.

11. The cutting element assembly of claim 10, wherein each cutting element with its bonded mounting stud defines a cutting element body having a height, a width, and a depth, and wherein normal wear of the cutting element body during drilling produces a wear flat which comprises a transverse section drawn through the cutting element body, the fin and associated troughs provided behind the mounting body serving to retard and effectively reduce or eliminate the increase in wear flat area caused by normal wear of the cutting element body during drilling.

12. A drill bit having an improved cutting element retention system for drilling a well borehole having a bottom, the bit comprising:

a bit body having a connecting end for engaging the mating connecting end of a pipe string used to support the bit within the well bore, the bit body having an opposite end which defines a bit face;

a plurality of fixed cutter cutting elements secured on the bit face, each fixed cutter cutting element having a mounting body with a leading face and a layer of superhard material carried on the leading face of the mounting body to define a cutting face for the cutting element; and at least one trough formed in the mounting body on the bit face behind the cutting ace of each cutter cutting element, each trough being sized and shaped whereby each cutting element has a characteristic wear flat bearing created by contact between the cutting element and the borehole bottom, the surface area of the wear flat bearing area of each cutting element retention system approaching a constant cross-sectional area throughout the entire cutting element usage.

* * * * *

UNITED STATES PATENT AND TRADEMARK OFFICE

CERTIFICATE OF CORRECTION

PATENT NO. : 5,007,493

DATED : April 16, 1991

INVENTOR(S) : Robert B. Coolidge and David M. Nguyen

It is certified that error appears in the above-identified patent and that said Letters Patent is hereby corrected as shown below:

In column 8, lines 26-27 the language reading "in generally" should read --in the matrix material of the bit face and arranged generally--.

In column 8, line 28: delete "."

In column 8, line 63 the language reading "face, for" should read --face, and the troughs extending for--.

In column 10, line 6 the language reading "ace" should read --face--.

Signed and Sealed this

Twelfth Day of January, 1993

*Attest:*

DOUGLAS B. COMER

*Attesting Officer*

*Acting Commissioner of Patents and Trademarks*